United States Patent [19]

Finlay

[11] 4,398,354

[45] Aug. 16, 1983

[54] BOW SQUARE HEAD

[75] Inventor: Robert L. Finlay, Emporia, Kans.

[73] Assignee: BPE, Inc., Emporia, Kans.

[21] Appl. No.: 346,630

[22] Filed: Feb. 8, 1982

[51] Int. Cl.[3] ..... F41B 5/00

[52] U.S. Cl. ..... 33/180 R; 124/24 R

[58] Field of Search ..... 124/1, 86, 90, 91, 80, 124/23 R, 24 R; 33/180 R

[56] References Cited

U.S. PATENT DOCUMENTS

| | | | |
|---|---|---|---|
| 3,088,212 | 5/1963 | Smith | 124/23 R X |
| 3,600,814 | 6/1971 | Smith | 124/23 R X |
| 3,651,578 | 3/1972 | Saunders et al. | 124/23 R X |
| 3,969,825 | 7/1976 | Mathes | 124/24 R X |

*Primary Examiner*—Richard C. Pinkham
*Assistant Examiner*—William R. Browne
*Attorney, Agent, or Firm*—Schmidt, Johnson, Hovey & Williams

[57] ABSTRACT

A compact, portable archery bow square head especially useful during hunting or field trips is provided which serves to accurately locate the nocking point on a bow string. The bow square head preferably includes a generally planar main member, a pair of spaced apart bow string-engaging clips projecting from the main member, a concical lug projecting outwardly from the main member in the same direction as the string-engaging clips, and an elongated, threaded lug projecting outwardly from the main member in opposed linear relationship with the conical lug. The conical lug is designed to support any of a variety of sizes of arrow nocks, and the threaded lug is designed to threadably receive the internally threaded, arrowhead fitting of an arrow shaft. The disclosed bow square head may be used to establish the nocking point on a bow string by attaching an arrow shaft and a nock on the appropriate lugs of the device, engaging the bow string within the bow string-engaging clips, and positioning the arrow shaft so as to come in contact with the arrow rest of the bow.

5 Claims, 7 Drawing Figures

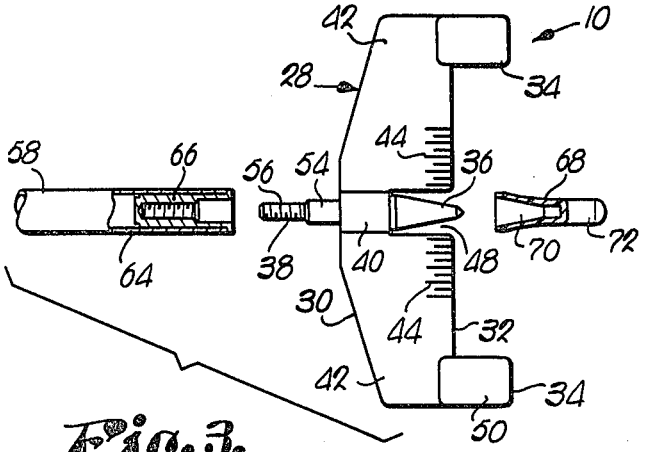
Fig. 3.
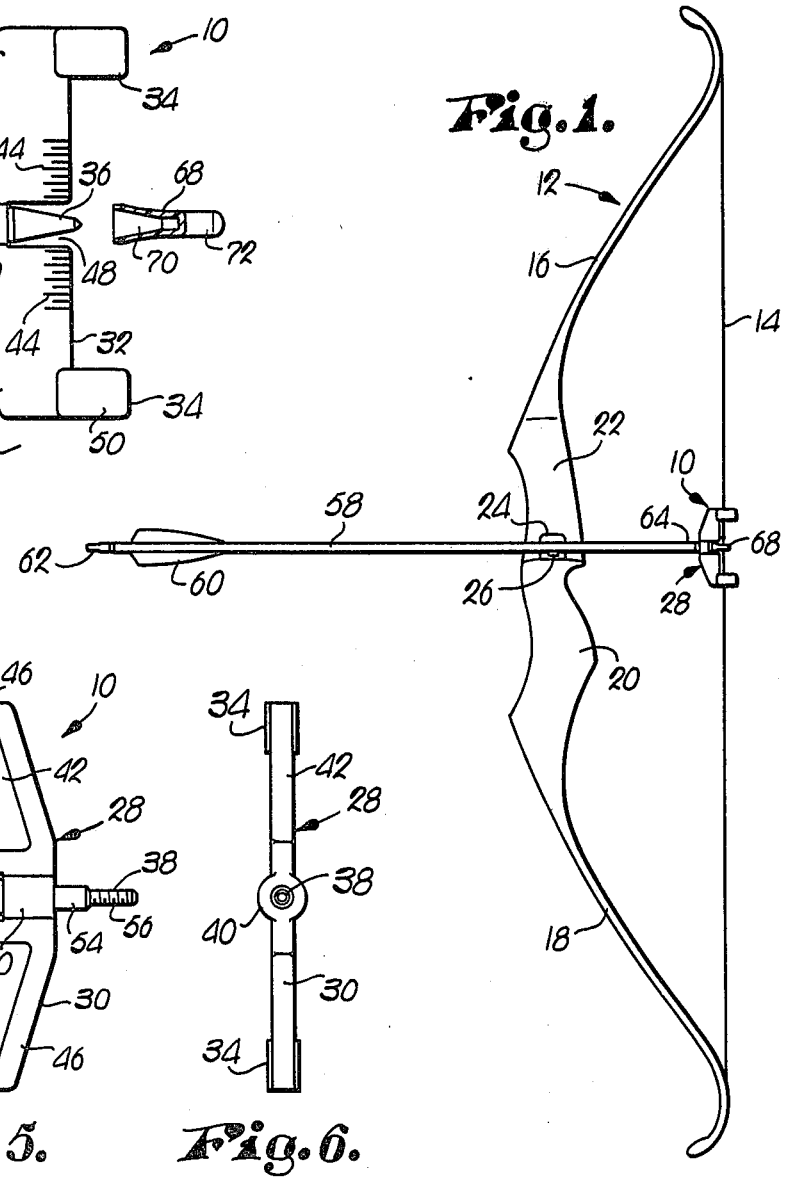
Fig. 1.
Fig. 4.
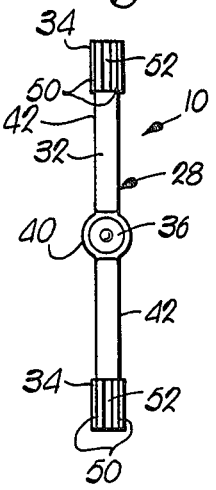
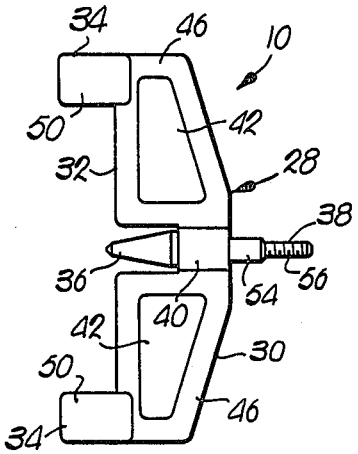
Fig. 5.
Fig. 6.
Fig. 2.
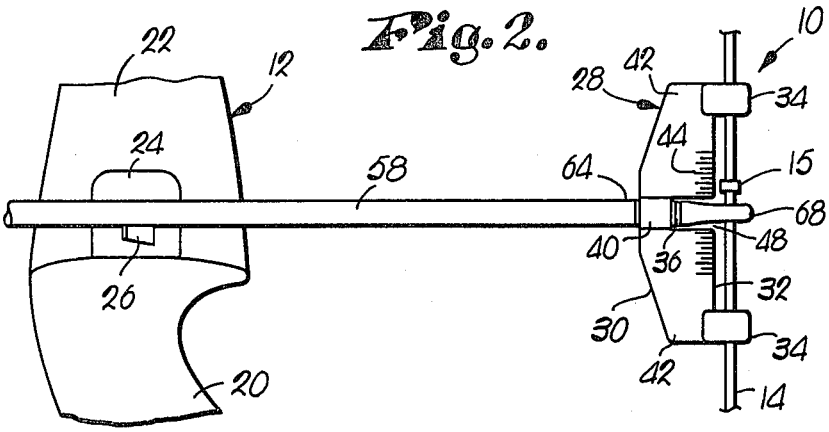
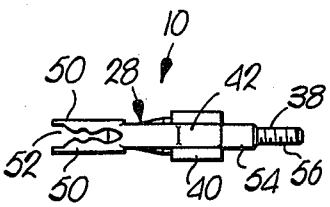
Fig. 7.

BOW SQUARE HEAD

BACKGROUND OF THE INVENTION

1. Field of the Invention

This invention relates to a bow square head of simple yet highly effective construction which has numerous advantages including compactness, easy portability, and the ability to be used in the field. More particularly, it is concerned with a bow square head having a generally planar main member, a pair of bow string-engaging clips projecting outwardly from one edge of the main member, a conical nock-supporting lug projecting outwardly from the main member in the same direction as the bow string-engaging clips, and an elongated, threaded, arrow shaft-receiving lug projecting outwardly from the main member in opposed, linear alignment with the conical lug.

2. Description of the Prior Art

Nock locators are installed on bow strings to insure that arrows are consistently placed at the same point on the bow string. A nock locator (nocking point) can either be a commercially installed clamp-on or heat-shrink nocking point or may be nothing more than a few wraps of dental floss or nylon thread around the bow string. An arrow shaft properly positioned on a bow string for release will advantageously be just out of perpendicular arrangement with the bow string. That is to say, the nock, or string-engaging portion, of the arrow, will be located approximately one sixteenth to three sixteenths inch above the point where it would be on the bow string if the arrow shaft were to be perfectly perpendicular to the bow string.

A number of devices have been proposed in the past for accurately establishing the nocking point of a bow string. Heretofore, however, devices for locating the nocking point of a bow string have been cumbersome, and not suitable for use in the field. It is not uncommon, however, that bow strings must be replaced while in the field.

A device that would accurately establish the nocking point on a bow string, yet at the same time be portable and suitable for use in the field, would be a decided advantage.

SUMMARY OF THE INVENTION

The problems outlined above are in large measure solved by the bow square head in accordance with the present invention. That is to say, the bow square head hereof is lightweight, compact, easily portable, and serves to accurately locate the nocking point on a bow string.

The bow square head in accordance with the present invention broadly includes a generally planar main member having a pair of opposed edges, a pair of spaced apart opposed bow string-engaging clips projecting outwardly from the main member, a conical, nock-receiving lug projecting outwardly from the main member in the same direction as the bow string-engaging clips, and an elongated, arrow shaft-receiving, threaded lug projecting outwardly from the main member in opposed linear alignment with the conical lug.

BRIEF DESCRIPTION OF THE DRAWINGS

FIG. 1 is a side elevational view of a bow having a bow square head in accordance with the present invention attached to the bow string;

FIG. 2 is an enlarged, fragmentary view depicting a bow square head in accordance with the present invention attached to a bow string;

FIG. 3 is an exploded view depicting a bow square head in accordance with the present invention, a sectional view of a nock, and a fragmentary, partially sectional view of an arrow shaft;

FIG. 4 is an end elevational view of a bow square head in accordance with the present invention illustrating the string clips and conical lug thereof;

FIG. 5 is a side elevational view of a bow square head in accordance with the present invention;

FIG. 6 is an elevational view of a bow square head in accordance with the present invention illustrating the threaded lug thereof; and FIG. 7 is a plan view of a bow square head in accordance with the present invention.

DESCRIPTION OF THE PREFERRED EMBODIMENT

Referring to the drawing, a bow square head 10 in accordance with the present invention is depicted in FIG. 1 in conjunction with a bow 12. The bow 12 includes bow string 14 having a nock locator 15 (see FIG. 2), upper limb 16, lower limb 18, grip 20, and sight window 22. The sight window 22 includes an arrow plate 24, and an arrow rest 26 projecting outwardly from the plate 24.

The bow square head 10 broadly includes a main member 28 having opposed end surfaces 30, 32, a pair of spaced apart bow string-engaging clips 34, a conical, nock-supporting lug 36 and an elongated, arrow shaft-receiving threaded lug 38.

In more detail, the main member 28, clips 34, and conical lug 36 are an integral piece formed from molded synthetic resin material. The main member 28 includes a central cylindrical portion 40 and a pair of opposed, generally planar wing-like portions 42 extending from the cylindrical portion 40. Each of the planar portions 42 includes a scale 44 on one surface (FIG. 3) and generally quandrangular reinforcing ribs 46 on the opposite surface thereof. The cylindrical portion 40, along with the planar portions 42, cooperatively define a central recess 48 in the end edge 32 of the central member 28. The conical lug 36 is received within recess 48 and is supported at the base by the cylindrical portion 40.

The bow string-engaging clips 34 each comprise a bifurcated fork having biased-together prongs 50. Prongs 50 have smooth outer surfaces, and irregular inner surfaces that cooperatively define a string-engaging groove 52 (FIG. 7).

The threaded lug 50 is advantageously a light metal such as aluminum and includes a cylindrical base portion 54 and a threaded portion 56. The base portion 54 of the threaded lug 38 is supported by a cylindrical portion 40 of the central member 28 on its edge 30. The conical lug 36, threaded lug 38, and cylindrical portion 40 are substantially axially aligned as illustrated.

Referring to FIG. 1, an arrow shaft 58 having fletching 60 and a nock 62 attached thereto is depicted as threadably received by the threaded lug 38 of bow square head 10. As best seen in FIG. 3, the arrow tip 64 includes an arrowhead-receiving, internally threaded coupling 66. The internal recess 68 of coupling 66 matingly engages threaded lug 38. A second nock 68 is permanently affixed to and supported by the conical lug 36 of the bow square head 10. The nock 68 includes an internal, conical recess 70 at one end, and a bifurcated, string-engaging fork at its opposite end. (One prong 72 of the string-engaging fork is depicted in the cross-sectional illustration of nock 68 in FIG. 3.)

In operation, an archer first selects a nock of the type he uses on his arrows and permanently glues the nock into place on the conical lug 36. With the bow square head 10 thus configured, the head 10 may be conveniently transported by the archer in a pocket or the like, ready for field use. To locate the proper position for nock locator 15, the archer first removes the arrow head (not shown) from the arrow head-receiving coupling 66 of arrow shaft 58, and threadably connects the arrow shaft 58 to the threaded lug 38. Next, the archer engages the bow string 14 with the bow string-engaging clips 34 of the bow square head 10. It will be appreciated that when the bow string 14 is firmly engaged by clips 34, the bow string 14 will also be engaged by nock 38, and arrow shaft 58 will be oriented perpendicularly to the bow string 14. The bow square head 10 is then shifted along the bow string 14 until the arrow shaft 58 impinges against the arrow rest 26. The archer then uses scale 44 to locate a desired nocking point in relation to the orientation of the nock 68, and marks this point with the locator 15.

I claim:

1. A device for locating the arrow nocking point on a bow string, comprising:

a member presenting a pair of opposed surfaces;

means projecting from one of said surfaces for engaging a bow string;

structural means positioned centrally of said surfaces and having a first end for removably supporting an arrow nock which engages a bow string when the nock is operatively positioned on the structural means; and threaded means projecting from a second end of said structural means for threadably receiving the tip end of an elongated arrow.

2. A device as in claim 1, said bow string-engaging means comprising a pair of spaced apart, parallel clips.

3. A device as in claim 1, said first end of the structural means including a conical lug.

4. A device as in claim 1, said structural means being located within a recess formed by means connecting the opposed surfaces.

5. A device as in claim 1, including means presenting a scale on said member adjacent said structural means.

* * * * *